US010330439B2

(12) United States Patent
Jeung et al.

(10) Patent No.: US 10,330,439 B2
(45) Date of Patent: Jun. 25, 2019

(54) DISPLAY-TYPE OPTICAL TELESCOPE SIGHT

(71) Applicant: Bo Sun Jeung, Bucheon-si (KR)

(72) Inventors: Bo Sun Jeung, Bucheon-si (KR); Dong Hee Lee, Seongnam-si (KR)

(73) Assignee: Bo Sun Jeung, Gyeonggi-Do (KR)

( * ) Notice: Subject to any disclaimer, the term of this patent is extended or adjusted under 35 U.S.C. 154(b) by 545 days.

(21) Appl. No.: 14/020,530

(22) Filed: Sep. 6, 2013

(65) Prior Publication Data

US 2014/0008435 A1 Jan. 9, 2014

Related U.S. Application Data

(63) Continuation of application No. PCT/KR2012/001626, filed on Mar. 6, 2012.

(30) Foreign Application Priority Data

Mar. 8, 2011 (KR) ..... 10-2011-0020210

(51) Int. Cl.

| | |
|---|---|
| ***F41G 3/00*** | (2006.01) |
| ***F41G 1/30*** | (2006.01) |
| ***F41G 3/06*** | (2006.01) |
| ***F41G 3/08*** | (2006.01) |

(52) U.S. Cl.

CPC ..... *F41G 3/005* (2013.01); *F41G 1/30* (2013.01); *F41G 3/06* (2013.01); *F41G 3/08* (2013.01)

(58) Field of Classification Search

USPC ..... 235/407

See application file for complete search history.

(56) References Cited

U.S. PATENT DOCUMENTS

| | | | | |
|---|---|---|---|---|
| 2,190,567 A | | 2/1940 | Jung | |
| 2,190,569 A | | 2/1940 | Macgill | |
| 3,524,710 A | | 8/1970 | Rickert | |
| 3,672,782 A | | 6/1972 | Akin, Jr. | |
| 3,914,030 A | | 10/1975 | Weiss | |
| 3,963,356 A | | 6/1976 | Wiklund | |
| 4,269,476 A | | 5/1981 | Gauthier et al. | |
| 4,600,271 A | | 7/1986 | Boyer et al. | |
| 4,764,011 A | * | 8/1988 | Goldstein | F41G 1/30 356/251 |
| 5,205,044 A | * | 4/1993 | DePaoli | G02B 23/105 42/132 |

(Continued)

FOREIGN PATENT DOCUMENTS

| | | |
|---|---|---|
| CH | 619296 A5 | 9/1980 |
| EP | 0239700 A2 | 10/1987 |

(Continued)

OTHER PUBLICATIONS

International Search Report dated Sep. 28, 2012 in corresponding application No. PCT/KR2012/001626, 6 pages.

*Primary Examiner* — Rafferty D Kelly
(74) *Attorney, Agent, or Firm* — Baker & McKenzie LLP

(57) ABSTRACT

An optical sight device includes a housing, a display panel and a reflecting element. The reflecting element is disposed in the housing. The reflecting element is disposed along an optical path defined from a point of an observer looking through the housing to the display panel. The reflecting element is provided between the observer and the display panel.

25 Claims, 3 Drawing Sheets

(56) References Cited

U.S. PATENT DOCUMENTS

| | | | | |
|---|---|---|---|---|
| 5,272,514 | A | 12/1993 | Dor | |
| 5,373,644 | A | 12/1994 | DePaoli | |
| 5,493,450 | A | 2/1996 | Ekstrand | |
| 5,508,843 | A | 4/1996 | Tomita | |
| 5,532,875 | A | 7/1996 | Betensky | |
| 5,625,954 | A | 5/1997 | DePaoli | |
| 5,686,690 | A * | 11/1997 | Lougheed | F41A 17/08 348/155 |
| 5,813,159 | A | 9/1998 | Kay et al. | |
| 6,327,806 | B1 | 12/2001 | Paige | |
| 6,967,775 | B1 | 11/2005 | Millett | |
| 7,234,265 | B1 | 6/2007 | Cheng et al. | |
| 7,292,262 | B2 * | 11/2007 | Towery | F41G 1/54 348/139 |
| 2005/0057808 | A1 * | 3/2005 | Houde-Walter | F41C 27/00 359/566 |
| 2006/0164704 | A1 | 7/2006 | Sieczka et al. | |
| 2007/0180751 | A1 | 8/2007 | Joannes | |
| 2009/0265974 | A1 | 10/2009 | Joannes | |
| 2010/0083554 | A1 | 4/2010 | Elpedes et al. | |
| 2012/0106170 | A1 * | 5/2012 | Matthews | F41G 1/30 362/311.06 |

FOREIGN PATENT DOCUMENTS

| | | |
|---|---|---|
| JP | 03-191389 | 8/1991 |
| KR | 10-0667472 | 1/2007 |
| KR | 10-0921308 | 10/2009 |

* cited by examiner

| | mm |
|---|---|
| R1 | -145.858 |
| R2 | -252.924 |
| R3 | -147.217 |

CONIC COEFFICIENT OF R2 0.188564

DISPLAY-TYPE OPTICAL TELESCOPE SIGHT

CROSS-REFERENCE TO RELATED APPLICATIONS

This application is a continuation of PCT/KR2012/001626, filed on Mar. 6, 2012, which claims priority to Korean Application No. 10-2011-0020210, filed on Mar. 8, 2011, each of which are incorporated by reference in their entirety.

BACKGROUND

The present disclosure relates to a display-type optical sight device, and more particularly, to a display-type optical sight device whereby a video image including aiming information is displayed together with an aim indicator (reticle) in the state in which parallax is corrected, so that asthenopia caused by repetitive accommodation of the eye(s) can be prevented.

Aiming a gun is achieved by visually aligning a front sight and a rear sight. Aiming by visually aligning the front sight placed at an end of a gun barrel and the rear sight placed at an upper portion of a main body of the gun enables precise shooting depending on the skill of a shooter of the gun. However, visual alignment is difficult due to even small vibration or shaking, and rapid aiming required at a near distance or in an urgent situation cannot be easily performed. That is, such an aimed shooting method requires complicated procedures and time to acquire and ascertain a target, align the sights, aim at the target, and the like. Since the front sight and the rear sight themselves are very small, not only are they susceptible to even a minor shaking, but also the shooter's eye(s) turns upon the front sight and the rear sight rather than at the target or a forward situation. Therefore, a field of view becomes narrow when the shooter pays too much attention to sight alignment in order to accurately align the front sight and the rear sight.

Thus, an optical sight device has been proposed to improve upon the above cumbersome sight alignment and further improve accuracy. However, since a telescopic lens is used in the optical sight device, when magnification increases, the optical sight device is susceptible to even minor shaking, so that it is difficult to perform rapid aiming.

In order to address this problem, an optical dot-sight device in which a non-magnifying (low-magnification) lens may be employed and only a simple dot of sight is used instead of complicated sight alignment.

Simple and quick aiming may be possible with an optical dot-sight device. Also, it is advantageous for quick aiming at a short distance or in an urgent situation. In other words, it takes little time to align the line of sight, aiming is performed by rapidly aligning a dot that is a virtual image of a light point formed from a mask or a projection reticle placed in front of a light emitting diode (LED) with the target, and a wide field of view may be obtained. Therefore, the optical dot-sight device has advantages of minimizing time required for aiming and disturbance of a peripheral field of view and situation verification caused by aiming.

As illustrated in FIG. 1, an optical dot-sight device 1 includes an adjuster 7 that is placed on a top of a cylindrical sight housing 2 and used to align an internal tube body, a fixing grill 26 that is placed on a bottom of the sight housing 2 and detachably coupled to a rifle rear sight module by a rail, a protective window 10 placed at a front end of the sight housing 2, a light-emitting device 8 (LED or a laser diode (LD)) that is placed at a predetermined position inside the tube body within the sight housing 2 and emits light as a light source, and a reflector 9 having a certain radius of curvature and placed behind the protective window 10 within the sight housing 2.

The reflector 9 reflects beams emitted from a light point of the light-emitting device 8 toward an observer (user). A dot that is a virtual image of the light point is placed at the position of a target.

The observer (user) shoots when the dot that is the virtual image of the light point of the light-emitting device 8 and the target are aligned with each other, and thus aiming can be easily performed.

Theoretically, it is intended that beams emitted from the light point formed by the light-emitting device 8 placed inside the optical dot-sight device 1 are reflected by the reflector 9 and enter the observer's eye(s) nearly in parallel and in alignment with a bullet shooting axis of the gun barrel. However, if the axis of the optical dot-sight device 1 is not aligned with the bullet shooting axis of the gun barrel, the target is missed, even though the observer aligns the dot that is the virtual image of the light point of the light-emitting device 8 with the target. Thus, in order to align the axis of the optical dot-sight device 1 with the bullet shooting axis of the gun barrel, the adjuster 7 for aligning the internal tube body having elevation and windage adjustment functions is provided to align the optical axis of the inner tube body with the bullet shooting axis of the gun barrel.

The reflector 9 reflects the beams emitted from the light point of the light-emitting device 8 toward the observer (user). The dot that is the virtual image of the light point is viewed to overlap the position of the target. A transmission-type liquid crystal display (LCD) display window is installed at a certain position of the reflector 9 by disposing transparent electrodes so as to display information required for shooting, such as a wind speed, a degree of inclination of a current area, and information regarding an enemy, in addition to the light point. In this case, since a point of fixation (or an object of regard) of the observer's eye(s) is not aligned with the position of the dot that is the virtual image of the light point in the light-emitting device 8 and the position of an image of a window for displaying information installed at the reflector 9, the observer (user) has to accommodate his/her eye(s) so as to verify the image of the window while seeing the dot that is the virtual image of the light point and the target.

However, repetitive eye accommodation causes accommodative fatigue or asthenopia. Thus, a method using the window for displaying information attached to the reflector 9 causes the user's eye(s) to easily become fatigued, and causes the speed of shooting on the target to be lowered when the optical sight device is used for a long duration. Also, the dot-sight device employing the method and other dot-sight devices that have been developed to date use a method in which it is difficult to change the shape of the light point according to the size of the target and the distance to the target.

BRIEF SUMMARY

In an embodiment, an optical sight device includes a sight housing, a reflecting element, and an image output unit. The sight housing includes a connecting element. The connecting element is configured to detach and attach to a gun. The reflecting element is disposed in a passage of the sight housing. The reflecting element includes a doublet. A first surface of the doublet and a third surface of the doublet are spherical surfaces. The image output unit is disposed in the sight housing. The image output unit provides aiming information including an aiming information video or an image to a second surface of the reflecting element. The second surface of the reflecting element causes the aiming information to be reflected towards and viewable to an observer.

In another embodiment, an optical sight device includes a housing, a display panel and a reflecting element. The reflecting element is disposed in the housing. The reflecting element is disposed along an optical path defined from a point of an observer looking through the housing to the display panel. The reflecting element is provided between the observer and the display panel.

DETAILED DESCRIPTION

Figure 1:
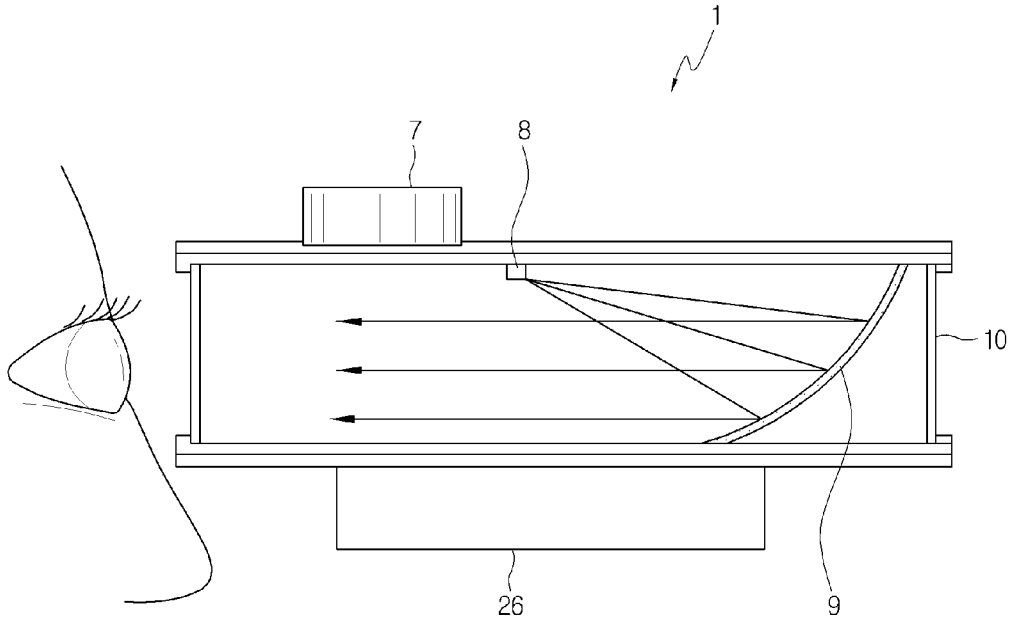
FIG. 1 is a diagram schematically illustrating an internal configuration of an optical dot-sight device.

In an embodiment, a display-type optical sight device may be capable of displaying a video or an image including aiming information together with an aim indicator (reticle) in the state in which parallax is substantially corrected, so that asthenopia caused by repetitive accommodation of the eye(s) can be remarkably prevented.

In another embodiment, a display-type optical sight device may include a measuring sensor for measuring the size of the target, a distance to the target, and a moving speed of the target is provided, and so measurement data can be displayed as an aiming information image together with an aim indicator (reticle). That is, compared to the dot-sight device according to the related art in which it is difficult to change the shape of a light point according to the size of the target and the distance to the target, according to the aim indicator (reticle) of the present disclosure, various shapes of light points or aim indicators (reticles) can be displayed through a combination of pixels of an organic light-emitting device OLED panel or a liquid crystal display (LCD) panel, as illustrated, for example, in FIG. 6.

In another embodiment, a display-type optical sight device may include a data communication module that is capable of performing wireless transmission and reception with a server of a command and control center is provided, and so environmental information, such as a temperature, a wind speed, and a wind direction in a vicinity of the target provided from the server of the command and control center is received in a wireless manner, and received data can be displayed as an aiming information image together with an aim indicator (reticle).

In order to achieve some or all of the above objects, an aspect of the present disclosure provides a display-type optical sight device, which includes a sight housing that includes a passage whose front and back are open and is detachable from and attachable to a top end of a gun, a reflector that is installed in the passage of the sight housing, and an image output unit that is installed in the sight housing and provides aiming information including an aim indicator (reticle) toward the reflector, wherein the reflector is configured with a doublet, a first surface and a third surface of the reflector are spherical surfaces, a second surface of the reflector serves as an aiming information reflection surface, and the second surface of the reflector is used to cause an aiming information video or image provided from the image output unit to be viewed as a virtual image to an observer.

Preferably, the image output unit includes a flat panel display device.

Preferably, radii of curvature of the first surface and the third surface of the reflector are configured to satisfy the following Equation to constitute an afocal optical system:

$$D_1 = \frac{n-1}{R_1},\ D_2 = \frac{1-n}{R_3}$$

$$D_1 + D_2 - \frac{d}{n} D_1 D_2 = 0,$$

wherein D1 is a refractive power of the first surface R1, D2 is a refractive power of the third surface R3, d is a distance between the first surface R1 and the third surface R3, R1 is a radius of curvature of the first surface R1, R3 is a radius of curvature of the third surface R3, and n is a refractive index.

Preferably, the second surface is an aspherical surface including a conic coefficient.

Preferably, the display-type optical sight device may further include a measurement sensor that is installed at the sight housing and measures a target and a controller that provides measurement data measured by the measurement sensor as aiming information of the image output unit together with the aim indicator (reticle).

Preferably, the sight housing further includes a data communication module that is connected to the controller, and the controller includes received data received from the data communication module in the aiming information of the image output unit and then provides the aiming information.

According to the present disclosure, a display-type optical sight device may be capable of displaying a video image including aiming information together with an aim indicator (reticle) in which parallax is substantially corrected so that asthenopia caused by repetitive accommodation of the eye(s) can be remarkably prevented.

Also, according to the present disclosure, a display-type optical sight device may include a measuring sensor for measuring the size of the target, the distance to the target, and a moving speed of the target is provided, and so measurement data can be displayed as an aiming information image together with an aim indicator (reticle).

Furthermore, according to the present disclosure, a display-type optical sight device may include a data communication module that is capable of performing wireless transmission and reception with a server of a command and control center is provided, and so environmental information, such as a temperature, a wind speed, and a wind direction in a vicinity of a target provided from the server of the command and control center is received in a wireless manner, and received data can be displayed as an aiming information image together with the aim indicator (reticle).

Before a description proceeds, in the following embodiments, like parts are denoted by like reference numerals, and a description will first proceed with a first embodiment, and different parts from those in the first embodiment will be described in another embodiment.

Hereinafter, a display-type optical sight device according to a first embodiment of the present disclosure will be described in detail with reference to the appended drawings.

Figure 2:
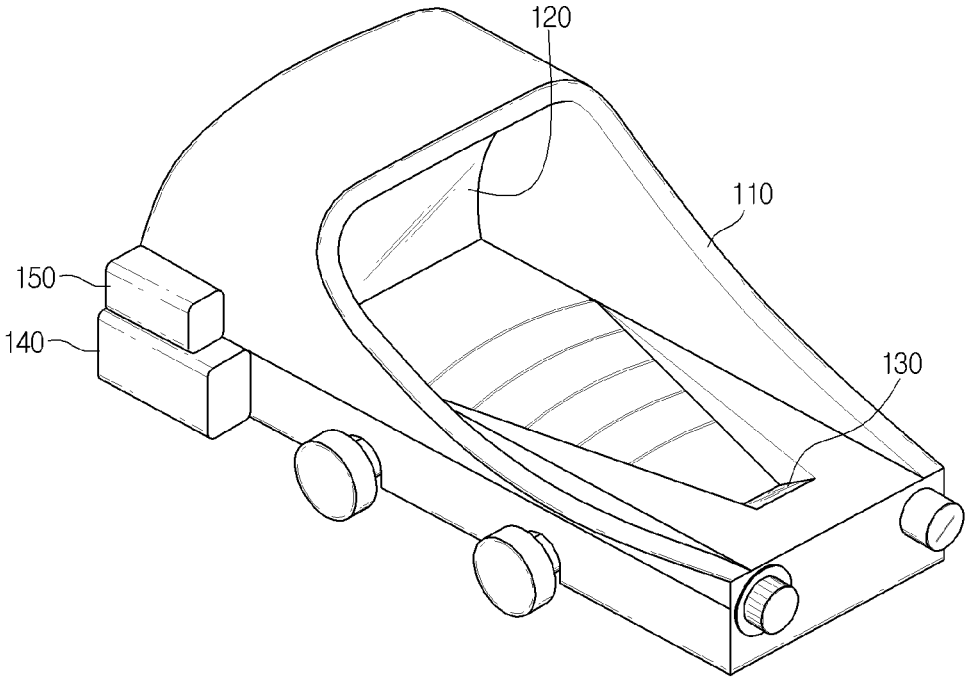
FIG. 2 is a perspective view of a display-type optical sight device.
Figure 3:
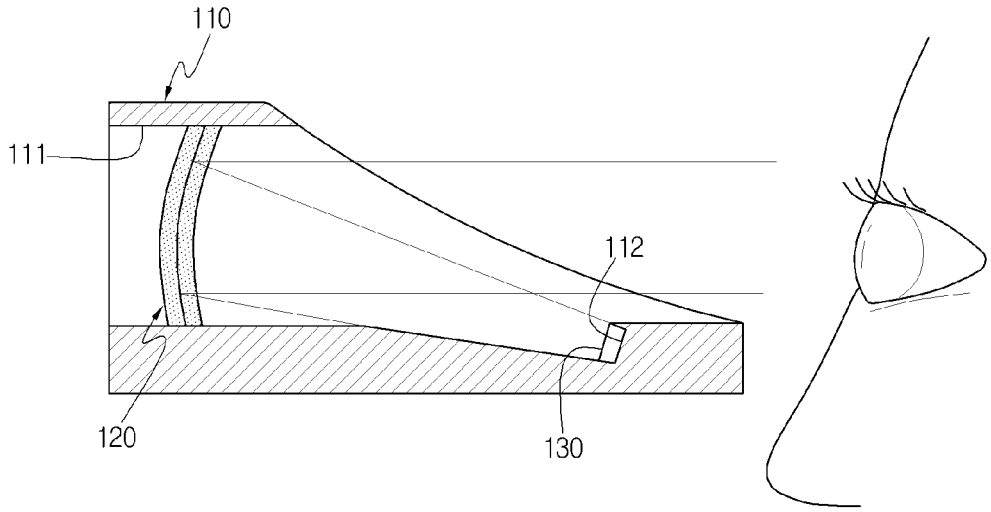
FIG. 3 is a cross-sectional view of a display-type optical sight device.

FIG. 2 is a perspective view of a display-type optical sight device, and FIG. 3 is a cross-sectional view of the display-type optical sight device.

As illustrated in FIGS. 2 and 3, the display-type optical sight device includes a sight housing 110, a reflector 120, a video or image (hereinafter, "image") output unit 130, a measuring sensor 140, a data communication module 150, and a controller 160.

The sight housing 110 includes a passage 111 whose front and back are open, and a mounting part 112 formed at one side of the passage 111. The sight housing 110 is detachably assembled with a top end of a gun, such as a rifle. The sight housing 110 further includes a position adjustment member for aligning a bullet shooting axis of a gun barrel with an optical axis of the reflector 120 installed at the sight housing 110. The position adjustment member has a well-known configuration and thus a detailed description thereof will be omitted.

The reflector 120 is installed in the passage 111 of the sight housing 110 and causes an aiming information image provided from the image output unit 130 as a virtual image to be viewed by an observer (i.e., a user). The reflector 120 is configured as a doublet. A first surface R1 and a third surface R3 of the reflector 120 form spherical surfaces, a second surface R2 provides an aiming information reflection surface, and radii of curvature of the first surface R1 and the third surface R3 are set to satisfy the following Equation (1) to provide an afocal optical system. The second surface R2 may have a spherical surface or an aspherical surface including a conic coefficient.

$$D_1 = \frac{n-1}{R_1},\ D_2 = \frac{1-n}{R_3} \tag{1}$$

$$D_1 + D_2 - \frac{d}{n} D_1 D_2 = 0$$

Here, D1 is a refractive power of the first surface R1, D2 is a refractive power of the third surface R3, d is a distance between the first surface R1 and the third surface R3, R1 is a radius of curvature of the first surface R1, R3 is a radius of curvature of the third surface R3, and n is a refractive index.

The image output unit 130 is installed at the sight housing 110 to provide the aiming information image toward the reflector 120. The image output unit 130 includes a flat panel display device, such as an LCD or an OLED. Also, the image output unit 130 may be configured using a small flat panel display device, and in this case, system configuration efficiency can be improved, a compact small-sized system can be easily realized, and a projection optical system that displays various image information desired by the observer can also be easily realized.

The measuring sensor 140 is installed at the sight housing 110 and may be configured with a laser range finder that measures the size of the target, the distance to the target, and the moving speed of the target and provide the measured information as data, a charge-coupled device (CCD) imaging device, a device for analyzing the size and the moving speed of the target by analysis of pixels of an image captured by the CCD imaging device, or the like.

The data communication module 150 is installed at the sight housing 110 in a built-in manner or an externally mounted manner, and communicates with the server of the command and control center in a wireless manner. The data communication module 150 receives information about the number or the amount of targets or information about surrounding conditions of the target, such as a wind speed or a wind direction of a current area, from the server of the command and control center in a wireless manner, and provides the received information as data.

The controller 160 is equipped in the sight housing 110 and connected to the measuring sensor 140 and the data communication module 150, receives data provided from the measuring sensor 140 and the data communication module 150, and provides the data to the image output unit 130 so that the image output unit 130 can display an aim indicator (reticle) selected according to situation as the aiming information image together with the data.

An operation of the above-described display-type optical sight device illustrated in FIG. 2 will now be described below.

Figure 4:
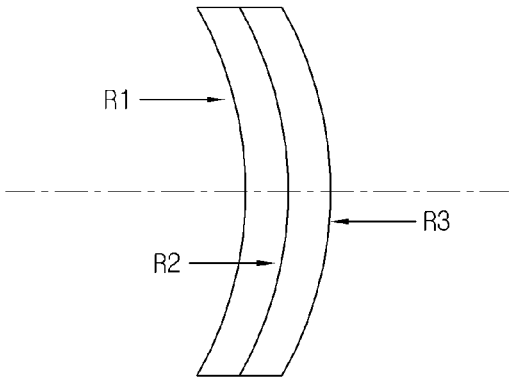
FIG. 4 is a diagram schematically illustrating a structure of a reflector.
Figure 5:
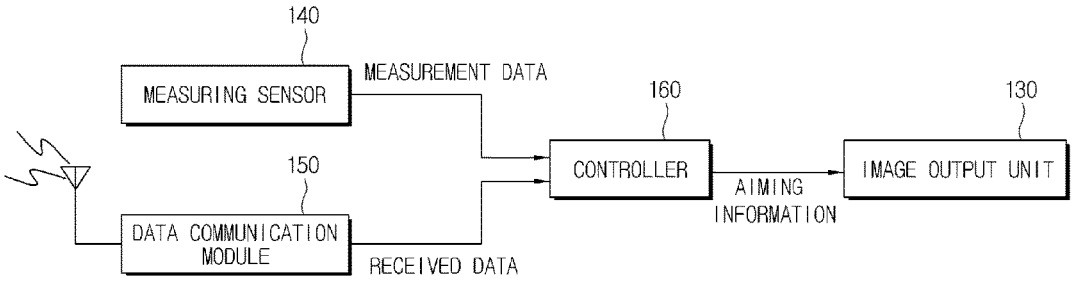
FIG. 5 is a diagram illustrating a configuration of a display-type optical sight device.
Figure 6:
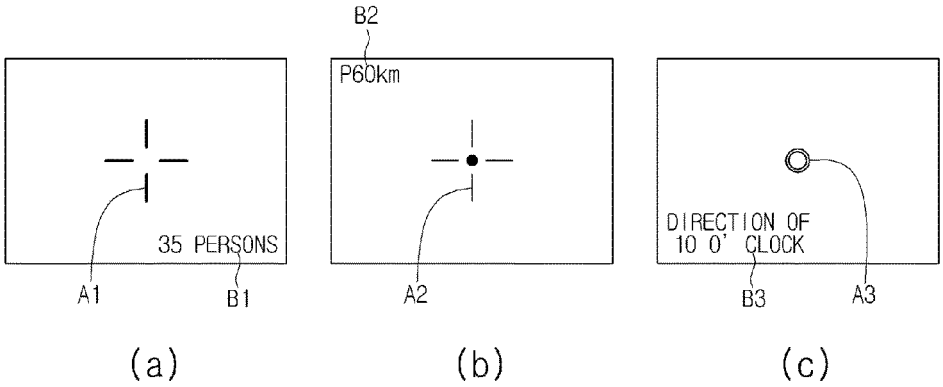
FIG. 6 illustrates various usage examples of aiming information images of the display-type optical sight device of FIG. 2.

FIG. 3 is a cross-sectional view of the display-type optical sight device, FIG. 4 schematically illustrates a structure of a reflector, FIG. 5 is a configuration diagram of the display-type optical sight device, and FIG. 6 illustrates various usage examples of aiming information images of the display-type optical sight device.

First, referring to FIG. 3, the image output unit 130 is installed at the mounting part 112 provided at one side of the passage 111 of the sight housing 110, and the reflector 120 is installed in the passage 111 of the sight housing 110. In this case, since the mounting part 112 is disposed to be inclined in the vicinity of a focal point of the reflector 120 disposed in the passage 111 of the sight housing 110, the aiming information image provided from the image output unit 130 installed at the mounting part 112 is reflected by the reflector 120 and provided to the observer.

Thus, the observer is able to simultaneously observe an image of the target shown through the passage 111 of the sight housing 110 and the aiming information image reflected by the reflector 120.

In this case, in order to improve a target shooting accuracy rate, the position of the reflector 120 needs to be appropriately adjusted within the sight housing 110 and fixed thereto so that parallax becomes substantially zero when beams emitted from an optical center of the aim indicator (reticle) of the image output unit 130 are reflected by the reflector 120 and directed toward the observer's eye(s). In other words, when, in actuality, there are no beams emitted from the optical center as illustrated in FIGS. 6A and 6C, the position of the reflector 120 needs to be appropriately adjusted in the sight housing 110 and fixed thereto so that parallax becomes substantially zero when the virtual reflected beams are reflected by the reflector 120 and directed toward the observer's eye(s) on the assumption that virtual beams are emitted from the optical center of the aim indicator (reticle).

FIG. 4 illustrates the structure of the reflector 120. In the present embodiment, a distance between the image output unit 130 and the reflection surface is set to 200 mm.

The aiming information image provided from the image output unit 130 is reflected from the second surface R2 of the reflector 120. At this time, the aiming information image passes through the first surface R1, is reflected from the second surface R2, passes through the first surface R1 again, and then is incident on the observer's eye(s). In other words, since the aiming information image passes through the first surface R1 that is a variable twice and is reflected from the second surface R2 once, a greater degree of freedom in design is provided. Thus, parallax can be further minimized.

The reflector 120 is configured with a doublet, and radii of curvature of the first surface R1 and the third surface R3 provide an afocal optical system that satisfies the following Equation 2. Thus, the reflector 120 may minimize parallax and magnification of an external target when an image of the external target is formed in the observer's eye(s).

$$D_1 = \frac{n-1}{R_1},\ D_2 = \frac{1-n}{R_3} \tag{2}$$

$$D_1 + D_2 - \frac{d}{n} D_1 D_2 = 0$$

(Here, D1 is a refractive power of the first surface R1, D2 is a refractive power of the third surface R3, d is a distance between the first surface R1 and the third surface R3, R1 is a radius of curvature of the first surface R1, R3 is a radius of curvature of the third surface R3, and n is a refractive index.).

In particular, the second surface R2, which is disposed between the first surface R1 and the third surface R3 and reflects the aiming information image toward the observer, may be a spherical surface. However, when the second surface R2 is an aspherical surface including a conic coefficient, the aiming information image in which parallax has further been corrected is reflected toward the observer. In other words, since the aiming information image reflected from the second surface R2 is viewed at the same point of sight as the target, asthenopia can be minimized even when the observer views the aiming information image in the state in which an observer's eye fixation point is fixed to the target.

Thus, the observer need not repeatedly adjust the fixation point of the observer's eye(s) to view the aiming information image positioned at a different point of sight from the target, like in the related art. Thus, asthenopia can be remarkably reduced, and the observer can see information related to aiming through the aiming information image in the state in which the observer's eye fixation point is fixed to the target, and so quick and accurate aiming and situation estimation can be achieved.

Referring to FIG. 5, measurement data, such as the size of the target, the distance to the target, and the moving speed of the target, measured by the measuring sensor 140, and received data, such as the number or the amount of targets or target surrounding conditions such as a wind speed and a wind direction, wirelessly received from the server of the command and control center through the data communication module 150, are supplied to the controller 160.

In addition, the controller 160 provides the aiming information image so that the measurement data supplied by the measuring sensor 140, the received data supplied from the data communication module 150, and the aim indicator (reticle) can be output from the image output unit 130.

The aiming information images output from the image output unit 130 are provided such that the aim indicator (reticle), the measurement data, and the received data are provided in various image forms. FIGS. 6(A) to 6(C) illustrate various types of aiming information images. FIG. 6A illustrates an example of an aiming information image including an aim indicator (reticle) A1 shaped like crosshairs with a blank center and received data B1 representing the number of persons around the target, FIG. 6B illustrates an example of an aiming information image including an aim indicator (reticle) A2 shaped like crosshairs including a central dot and measurement data B2 representing the moving speed of a target, and FIG. 6C illustrates an example of an aiming information image including an annular aim indicator (reticle) A3 and aiming information B3 representing a direction in which the target is positioned.

In other words, since the image output unit 130 is configured with a flat panel display device, such as an LCD or an OLED, the aiming information supplied from the controller 160 can be output in various shapes and colors.

Thus, since the aim indicator (reticle) can be changed according to the type of the target and the environment around the target, aiming at the target can be very easily performed according to a situation. Further, information about the distance to the target or the size of the target supplied from the measuring sensor 140 can be displayed together with the aim indicator (reticle), and the received data received from the server of the command and control center in the wireless manner can be output as the aiming information image.

As described above, since various pieces of information are provided as the aiming information image, the size of the target or the distance to the target need not be calculated through a scale marked on the aim indicator (reticle), and thus quick and accurate aiming can be performed.

According to the present disclosure, it is possible to provide a display-type optical sight device, which is capable of displaying a video or an image including aiming information together with an aim indicator (reticle) in the state in which parallax has been corrected and thus preventing asthenopia caused by repetitive accommodation of the eye(s).

While the invention has been shown and described with reference to certain exemplary embodiments thereof, it will be understood by those skilled in the art that various changes in form and details may be made therein without departing from the spirit and scope of the invention as defined by the appended claims. A person skilled in the art may find various alternations and modifications within the scope of the appended claims, and it should be understood that they will naturally come under the technical scope of the present invention. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Words of comparison, measurement, and time such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

The invention claimed is:

1. An optical sight device, comprising:

a sight housing that includes a passage and a connecting element, the passage having an open front and an open back, and the connecting element being configured to detach and attach to a gun;

a reflecting element disposed in the passage of the sight housing; and an image output unit disposed in the passage of the sight housing, the image output unit providing aiming information including an aim indicator and an aiming information video to the reflecting element, the reflecting element causing the aiming information to be reflected towards and viewable to an observer, wherein the reflecting element includes a doublet, a first surface of the doublet and a third surface of the doublet include spherical surfaces, the image output unit provides the aiming information video to a second surface of the reflecting element, and the second surface of the reflecting element causes the aiming information video to be reflected towards and viewable to an observer.

2. The optical sight device of claim 1, wherein the second surface is an aspherical surface having a conic coefficient.

3. The optical sight device of claim 1, further comprising:

a measurement sensor that obtains measurement data related to a target, the measurement sensor being disposed in the sight housing; and a controller configured to provide the aiming information to the image output unit, the aiming information including the measurement data.

4. The optical sight device of claim 3, wherein the sight housing includes a data communication module, and the controller is configured to receive data from the data communication module and to provide the aiming information including the data to the image output unit.

5. The optical sight device of claim 1, wherein the image output unit includes a flat panel display device.

6. The optical sight device of claim 5, further comprising:

a measurement sensor that obtains measurement data related to a target, the measurement sensor being disposed in the sight housing; and a controller configured to provide the aiming information to the image output unit, the aiming information including the measurement data.

7. The optical sight device of claim 6, wherein the sight housing includes a data communication module, and the controller is configured to receive data from the data communication module and to provide the aiming information including the data to the image output unit.

8. The optical sight device of claim 1, wherein the image output unit includes a flat panel display device, and the second surface is an aspherical surface including a conic coefficient.

9. The optical sight device of claim 1, wherein the sight housing and the reflecting element are arranged such that an observer is able to simultaneously observe a target and the aiming information.

10. The optical sight device of claim 1, wherein the housing includes an inclined recess, and the image output unit is disposed in the inclined recess.

11. The optical sight device of claim 1, wherein the passage of the sight housing includes a recess, and the image output unit is disposed in the recess.

12. The optical sight device of claim 1, wherein the doublet includes a first lens and a second lens disposed adjacent to the first lens.

13. The optical sight device of claim 12, wherein the first lens includes the first surface, the second surface includes an interface between the first lens and the second lens, and the second lens includes the third surface.

14. An optical sight device, comprising:

a sight housing that includes a connecting element, the connecting element being configured to detach and attach to a gun;

a reflecting element disposed in a passage of the sight housing, the reflecting element including a doublet, and a first surface of the doublet and a third surface of the doublet being spherical surfaces; and an image output unit disposed in the sight housing, the image output unit providing aiming information including an aiming information video or an image to a second surface of the reflecting element, the second surface of the reflecting element causing the aiming information to be reflected towards and viewable to an observer, wherein radii of curvature of the first surface and the third surface of the reflector satisfy the following equation:

$$D_1 = \frac{n-1}{R_1},\ D_2 = \frac{1-n}{R_3}$$

$$D_1 + D_2 - \frac{d}{n} D_1 D_2 = 0,$$

wherein D1 is a refractive power of the first surface, D2 is a refractive power of the third surface, d is a distance between the first surface and the third surface, R1 is a radius of curvature of the first surface, R3 is a radius of curvature of the third surface, and n is a refractive index.

15. The optical sight device of claim 14, wherein the second surface is an aspherical surface having a conic coefficient.

16. The optical sight device of claim 14, further comprising:

a measurement sensor that obtains measurement data related to a target, the measurement sensor being disposed in the sight housing; and a controller configured to provide the aiming information to the image output unit, the aiming information including the measurement data.

17. The optical sight device of claim 16, wherein the sight housing includes a data communication module, and the controller is configured to receive data from the data communication module and to provide the aiming information including the data to the image output unit.

18. An optical sight device, comprising:

a housing that includes a passage having an open front and an open back;

a display panel disposed in the passage and operable to project an aim indicator and an aiming information video; and a reflecting element disposed in the housing, wherein the reflecting element is disposed on an optical path defined from a point of an observer looking through the housing to the display panel, the reflecting element is provided between the observer and the display panel, the reflecting element includes a doublet, a first surface of the doublet and a third surface of the doublet include spherical surfaces, the display panel provides the aiming information video to a second surface of the reflecting element, and the second surface of the reflecting element causes the aiming information video to be reflected towards and viewable to an observer.

19. The optical sight device of claim 18, wherein the display panel is an electronic display panel.

20. The optical sight device of claim 19, wherein the display panel includes a liquid crystal display.

21. The optical sight device of claim 18, wherein the display panel includes an organic light-emitting device panel.

22. The optical sight device of claim 18, wherein the display panel is configured to display a reticle to an observer.

23. The optical sight device of claim 18, further comprising a data communication unit configured to receive information, wherein the display panel is configured to display the information to an observer.

24. The optical sight device of claim 18, wherein the reflecting element is a doublet, and an internal surface of the doublet reflects light irradiated by the display panel.

25. The optical sight device of claim 18, further comprising a sensor that obtains measurement data related to a target, wherein the display panel is configured to display the measurement data to an observer.

* * * * *